US005333794A

United States Patent [19]

Haruch

[11] Patent Number: 5,333,794

[45] Date of Patent: Aug. 2, 1994

[54] SPRAY NOZZLE WITH RECESSED DEFLECTOR SURFACE AND MOUNTING ASSEMBLY THEREOF

[75] Inventor: James Haruch, Naperville, Ill.

[73] Assignee: Spraying Systems Co., Wheaton, Ill.

[21] Appl. No.: 123,876

[22] Filed: Sep. 20, 1993

Related U.S. Application Data

[63] Continuation-in-part of Ser. No. 987,001, Dec. 7, 1992, Pat. No. 5,275,340, which is a continuation-in-part of Ser. No. 715,438, Jun. 14, 1991, Pat. No. 5,190,222.

[51] Int. Cl.[5] ..... B05B 15/06

[52] U.S. Cl. ..... 239/600; 239/523; 239/524

[58] Field of Search ..... 239/432, 434, 510, 512, 239/523, 524, 553.3, 600, DIG. 1

[56] References Cited

U.S. PATENT DOCUMENTS

| | | | |
|---|---|---|---|
| 3,082,961 | 3/1963 | Hruby, Jr. | 239/523 |
| 3,085,754 | 4/1963 | Thompson | 239/523 |
| 3,342,423 | 9/1967 | Hruby, Jr. et al. | 239/590.5 |
| 3,864,652 | 12/1968 | O'Brien et al. | 239/524 |
| 4,185,781 | 1/1980 | O'Brien | 239/600 |
| 4,353,508 | 10/1982 | Butterfield et al. | 239/590.3 |
| 4,356,974 | 11/1982 | Rosenberg et al. | 239/524 |
| 4,738,401 | 4/1988 | Filicicchia | 239/600 |
| 4,815,665 | 3/1989 | Haruch | 239/432 |
| 4,828,182 | 5/1989 | Haruch | 239/432 |
| 4,899,937 | 2/1990 | Haruch | 239/432 |
| 5,190,222 | 3/1993 | Haruch | 239/523 |
| 5,190,224 | 3/1993 | Hamilton | 239/600 |
| 5,199,649 | 4/1993 | Tolboll | 239/600 |

*Primary Examiner*—Karen B. Merritt

*Attorney, Agent, or Firm*—Leydig, Voit & Mayer, Ltd.

[57] ABSTRACT

A spray nozzle assembly having a spray tip formed with an elongated, cylindrical chamber communicating with the liquid supply and being formed with a cross-slot which intersects the chamber at a location intermediate the ends thereof for defining a discharge orifice, a deflection surface on a downstream side of the discharge orifice for directing liquid in a direction transverse to the axis of the chamber, and a pocket extending downstream of the deflector surface. In one embodiment, the spray tip has a pre-orifice substantially smaller in diameter than the chamber adjacent an upstream end thereof, in another embodiment, the chamber is disposed with its axis at an angle to the vertical and the cross-slot extends upwardly in substantially vertical relation for defining a vertical deflection surface, and in still another embodiment the spray tip has a wear resistant metal insert. In yet another embodiment, the chamber extends horizontally and has a long dimension which is significantly greater than the correspondingly extending dimension of an opening through a retention cap.

6 Claims, 7 Drawing Sheets

SPRAY NOZZLE WITH RECESSED DEFLECTOR SURFACE AND MOUNTING ASSEMBLY THEREOF

This application is a continuation-in--part of application Ser. No. 07/987,001, filed Dec. 7, 1992, now U.S. Pat. No. 5,275,340 which, in turn, is a continuation-in--part of application Ser. No. 07/715,438, filed Jun. 14, 1991, now U.S. Pat. No. 5,190,222.

FIELD OF THE INVENTION

The present invention relates generally to spray nozzles, and more particularly, to spray nozzle assemblies of the type which have a spray tip with a transversely oriented deflector flange formed with a distinct recess or pocket for the purpose of effecting a particular desired liquid distribution in the discharging spray.

BACKGROUND OF THE INVENTION

Spray nozzle assemblies are known, such as shown in U.S. Pat. No. 4,899,937 assigned to the same assignee as the present invention, which include a deflector flange that enhances particle breakdown and directs the spray pattern in a transverse direction. The deflector flange of the nozzle shown in the aforesaid United States patent is formed with a distinct recess or pocket in axial alignment with the liquid discharge orifice in the nozzle tip, which has been found to generate a spray pattern that has shallow bell-shaped liquid distribution curve with greatest quantities of liquid being directed in a central portion of the spray pattern and lesser quantities on opposite sides thereof so that overlapping spray patterns from a plurality of such nozzles mounted in laterally spaced relation to each other, such as on the boom on an agricultural sprayer, produce a substantially uniform distribution of liquid over the area being sprayed.

In hydraulic spraying applications, namely applications in which the liquid flow stream is not subject to air-assisted pre-atomization, such nozzles have been found to be susceptible to excessive wear that can alter the spray characteristics and substantially increase the liquid flow. Although wear is reduced if the liquid is pre-atomized by pressurized air prior to direction through the nozzle spray tip, such air assisted spraying generates a fog-like discharge of relatively fine liquid particles. In agricultural applications, unless such discharging spray is directed in a substantially straight downward direction, the fine liquid particles are subject to undesirable drift. Heretofore, it often has not been possible to easily mount such spray nozzles for straight downwardly directed spraying, particularly on booms which are adapted for vertical spray nozzle mounting. Since the deflector flange of the nozzle is disposed transversely to the discharge orifice, such nozzles also have been susceptible to clogging by solid materials that might be included in the liquid being sprayed.

OBJECTS AND SUMMARY OF THE INVENTION

It is an object of the present invention to provide a spray nozzle assembly with a spray tip having a recessed deflector flange that may be utilized for hydraulic spray applications to generate a controlled shallow bell-shaped liquid distribution with less susceptibility to wear.

Another object provides a spray nozzle assembly as characterized above which can be easily mounted on an agricultural spray boom for directing the discharging spray in a substantially straight downward direction, without tedious adjustment or manipulation of the nozzle during mounting.

A further object is to provide a spray nozzle assembly of the above kind that is adapted for spraying solids containing liquids with less tendency for clogging.

Still another object is to provide a spray nozzle assembly of the aforementioned type and having an advantageously elongated and high capacity nozzle tip that can be readily assembled with a standard retention cap.

Other objects and advantages of the invention will become apparent upon reading the following detailed description and upon reference to the drawings, in which:

Figure 1:
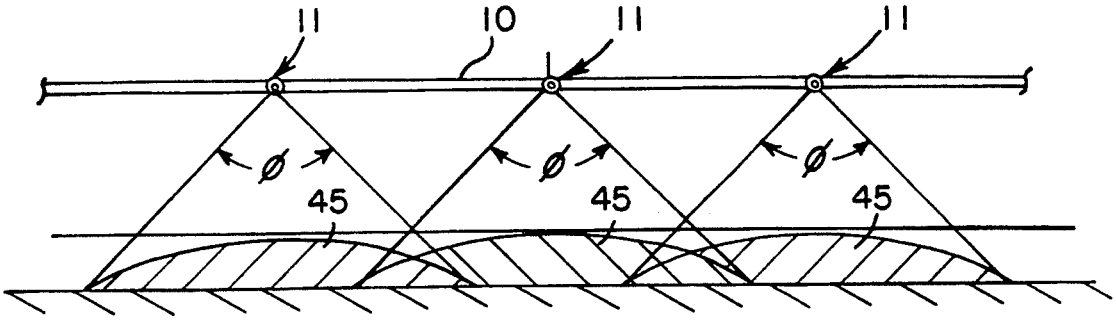
FIG. 1 is a partially diagrammatic depiction of the performance of a plurality of nozzle assemblies embodying the present invention mounted in laterally spaced relation to each other on a spray boom, with the liquid distribution curve of each nozzle assembly depicted below the respective nozzle assembly.

While the invention is susceptible of various modifications in alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalence falling within the spirit and scope of the invention.

DETAILED DESCRIPTION OF THE PREFERRED EMBODIMENTS

Figure 2:
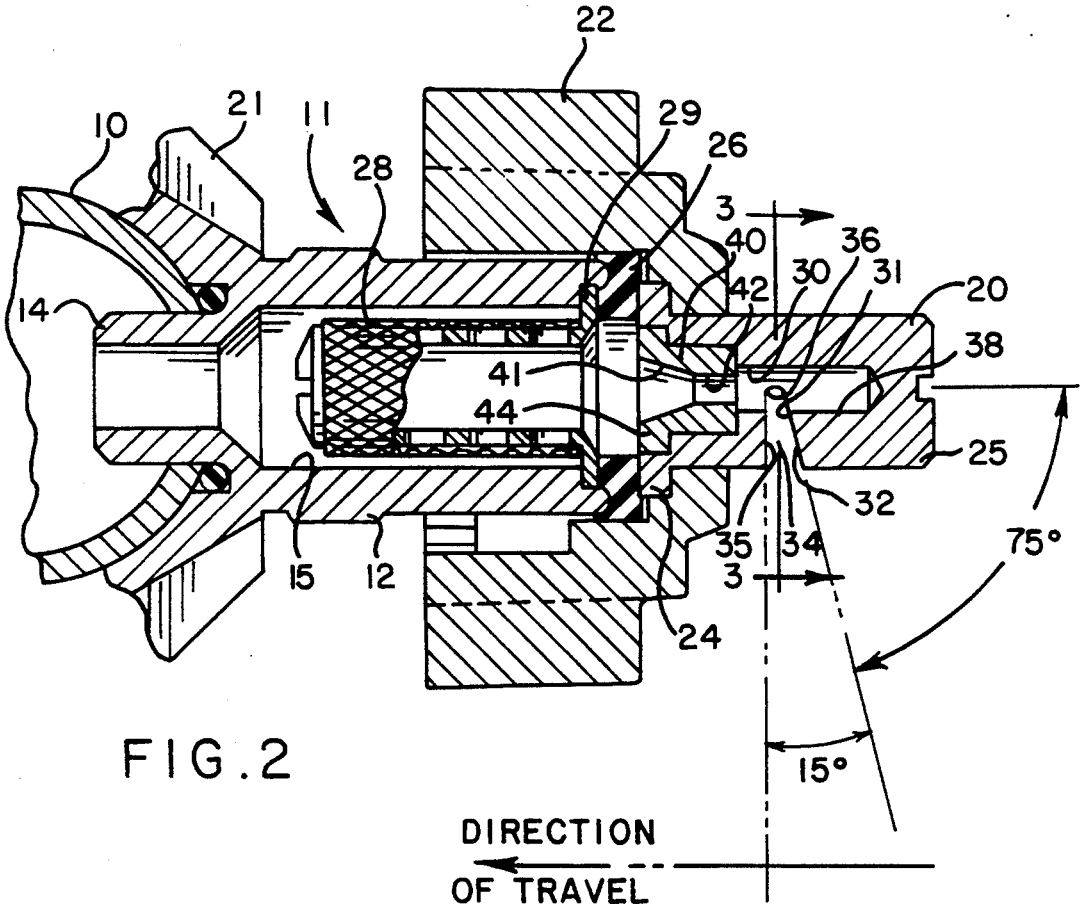
FIG. 2 is an enlarged fragmentary section of one of the spray nozzle assemblies.
Figure 3:
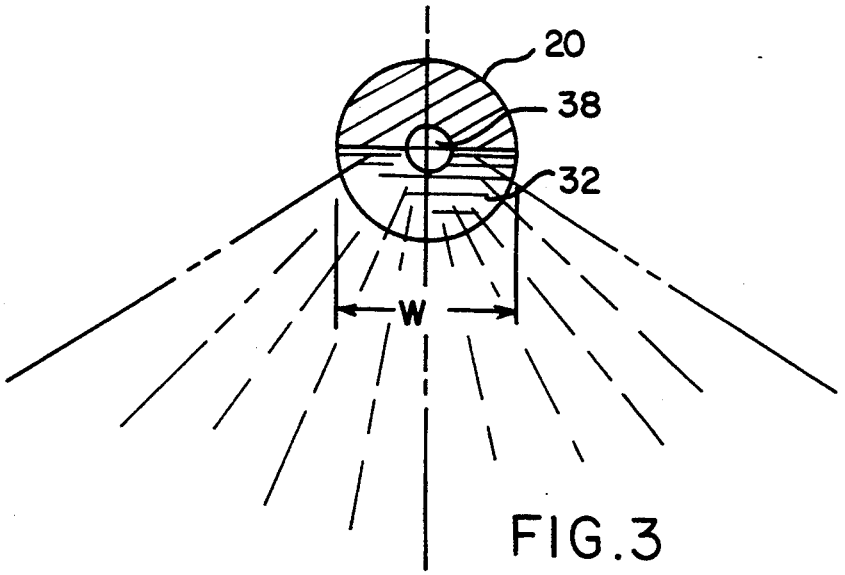
FIG. 3 is an enlarged vertical section of the spray tip of the nozzle assembly shown in FIG. 2, taken in the plane of 3—3.

Referring now more particularly to FIGS. 1-3 of the drawings, there is shown a spray boom 10, such as the boom of an agricultural sprayer, having mounted thereon a plurality of spray nozzle assemblies 11 in accordance with the invention. The boom 10 in this instance is a tubular member through which the supply liquid is directed. Each spray nozzle assembly 11 includes a stem 12 having a nipple 14 extending into the boom 10 through an aperture in one side thereof. Pressurized liquid supplied to the boom 10 enters the stem 12 through the nipple 14 and passes through a central fluid passageway 15 in the stem 12 for direction through and discharge from a spray tip 20 mounted at the outer end thereof. The stem 12 is secured to the boom 10 by appropriate means, such as a clamp 21.

For removably securing the spray tip 20 to the stem 12, a retention cap 22 is provided, which may be of the type disclosed in Butterfield et al U.S. Pat. No. 4,527,745. The spray tip 20 has an outwardly extending flange 24 at its upstream end, seated in the cap 22 and a body portion 25 extending outwardly of the cap 22 through a central aperture therein. The retention cap 22 in turn is telescoped over the outer end of the stem 12. For locking the cap 22 and spray tip 20 in predetermined position on the stem 12, the stem 12 and cap 22 may be formed with cooperative locking lugs and slots as is known in the art. A resilient annular gasket 26 is interposed between the end of the spray tip mounting flange 24 and the end of the stem 12, and a strainer 28 is secured within the flow passageway 15 of the stem 12 with a mounting flange 29 thereof interposed between the resilient gasket 26 and a seat formed in the end of the stem 12. Liquid directed through the stem 12 passes through the strainer 28 prior to its direction through the spray tip 20.

The spray tip 20 is formed with an elongated chamber 30 that extends into the body 25 from an upstream end thereof for communication with the liquid passageway 15 in the stem 12. For defining a discharge orifice 31 and a deflection surface or face 32 for directing liquid in a downward direction transverse to the longitudinal axis of the stem 12 and spray tip 20, the spray tip 20 is formed with a cross slot 34 extending upwardly from and underside thereof. The cross slot 34 in this case defines a generally vertically directed upstream face 35 with the downstream deflection face 32 being oriented at an angle $\Theta$, which preferably may be between about 15 and 45 degrees, with respect to the vertical. The apex between the cross slot faces 32, 35 is connected by a round 36 preferably extending to the longitudinal axis of the spray tip chamber 30, which has been found to define a spray pattern with a relatively wide angle $\phi$ between about 120 and 130 degrees (FIG. 1) that is particularly desirable for agricultural spraying. Extending the cross slot 34 upwardly beyond the longitudinal axis of the chamber 30 has been effective for increasing the angle $\phi$ of the discharging spray pattern up to and approaching 180 degrees.

For enhancing liquid breakdown and atomization and for directing a discharging spray pattern with a shallow bell-shaped liquid distribution curve, the cross slot 34 intersects the chamber 30 intermediate the ends thereof for defining a significant recess or pocket 38 downstream of the discharge orifice 31 and deflector surface 32. The recess or pocket 38 extends beyond the deflector surface 32 a distance of at least twice, and preferably about 3 times the diameter of the chamber 30. While spray nozzles with recessed deflector flanges, such as shown in U.S. Pat. No. 4,899,937, have been found effective for generating sprays with bell-shaped liquid distribution curves, as previously indicated, when used in hydraulic, non-air-assisted spraying applications, such tips have been found to experience significant wear about the discharge orifice and deflector surface. As a result, use of such nozzles have been largely limited to air assisted spray applications in which a pre-atomized liquid flow stream is directed through the spray tip.

In accordance with the invention, the nozzles spray tip defines a pre-orifice upstream of the discharge orifice which is sized substantially smaller than the nozzle tip chamber such that the chamber and the deflector surface recess form an expansion chamber that facilitates breakdown and direction of the liquid particles with significantly reduced wear, while not substantially affecting the bell-shaped character of the liquid distribution of the discharging spray. To this end, in the illustrated embodiment, the spray tip 20 includes a pre-orifice member 40 that is press fit or otherwise secured in the upstream end of the spray tip 20. The pre-orifice member 40 is formed with an inwardly tapered entrance passageway or throat 41 for receiving supply liquid from the flow passageway 15 of the stem 12 and which communicates with a cylindrical pre-orifice 42 having a diameter preferably on the order of about ½ the diameter of the spray tip chamber 30 for throttling and accelerating liquid into the expansion chamber defined by the spray tip chamber 30 and deflector surface recess 38. The pre-orifice member 40 in this case has an outwardly extending, annular flange 44 at its upstream end received in a counterbore formed in the spray tip 20 for locating the upstream face of the pre-orifice member 40 flush with the upstream face of the nozzle tip 20. The discharge orifice 31 preferably has an area greater than the area of the pre-orifice 42 for insuring the free passage the liquid entering the chamber 30.

In operation, supply liquid from the boom 10 is directed to the spray tip 20 via the stem passageway 15. Liquid entering the spray tip 20 is accelerated as it passes through the pre-orifice 42 into the expansion chamber defined by the chamber 30 and deflector surface recess 38, where the liquid is broken down and mixed with significant turbulence. Liquid particles generated within the chamber 30 are directed through the discharge orifice 31 and along the deflector surface 32 where they are broken down further for ultimate direction in a fan-shaped spray pattern having a relatively wide angle $\phi$ of between about 120–130 degrees, as illustrated in FIG. 1. As further depicted in FIG. 1, the discharging spray generates a shallow or flat bell-shaped liquid distribution curve 45, with lesser quantities of liquid being generated at opposite sides of the spray pattern, thereby enabling the discharging sprays of adjacent nozzles to be directed for slight overlap with the resulting liquid distribution across the area sprayed being substantially uniform for optimum application of agricultural chemicals and the like. The pre-orifice member 40 has been found to significantly minimize wear to the discharge orifice 31 and deflector surface 32 of the spray tip 30, and the downwardly directed discharge orifice 31 of the spray tip enables the nozzle assembly to be used for agricultural applications in both for hydraulic and air-assisted spraying modes.

Figure 4:
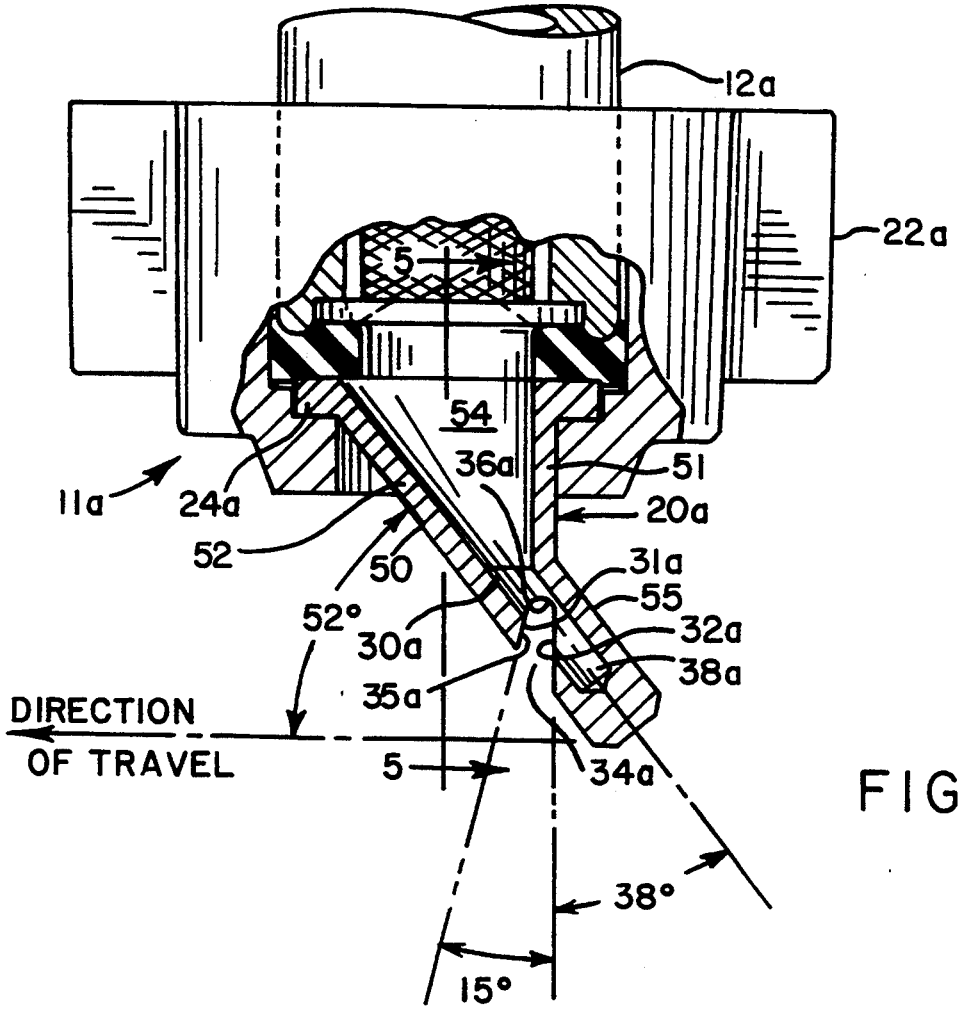
FIG. 4 is a side elevational view, in partial section, illustrating an alternative embodiment of the spray nozzle assembly according to the present invention, mounted in vertically depending relation from a horizontal spray boom.
Figure 5:
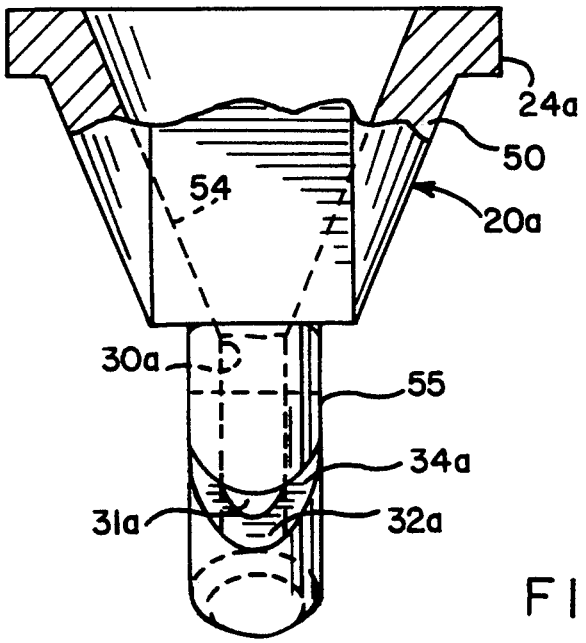
FIG. 5 is an enlarged side elevational view, in partial section, of the spray tip included in the nozzle assembly shown in FIG. 4.

Referring now to FIGS. 4 and 5, there is shown an alternative spray nozzle assembly 11*a* in accordance with the invention that is adapted for producing a downwardly directed spray, while being mounted on a vertical stem 12*a* of a conventional horizontal spray boom. Items similar to those described above have been given similar reference numerals with the distinguishing suffix "a" added. The nozzle assembly 11*a* in this case includes a spray tip 20*a* which again has an outwardly extending mounting flange 24*a* at its upstream end to facilitate releasable securement to the stem 12*a* by a retention cap 22*a*. The spray tip 20*a* has an upper portion 50 formed by a cylindrical wall 51 on one side thereof co-axial with the stem 12*a* and a side wall 52 which extends in skewed or angular relation to the longitudinal axis of the stem, which together define an entry chamber 54 that extends downwardly and to one side, as shown in FIG. 4. The spray tip 20*a* has a cylindrical extension 55 directed downwardly and an angle to the vertical axis as an extension of the skewed side wall 52. The cylindrical spray tip extension 55 is formed with a chamber 30*a* that communicates at its upper end with the tapered entry chamber 54.

In carrying out the invention, the spray tip extension 55 is formed with an upwardly directed, substantially vertically oriented cross slot 34*a* which defines a discharge orifice 31*a* for the spray tip 20*a* and a deflection surface 32*a* for directing a discharging liquid spray in a substantially downward direction. The cross slot 34*a* has a "V" configuration with the downstream deflection surface 32*a* defined thereby being substantially vertically oriented and an upstream side or face 35*a* thereof disposed at an angle Θ, which preferably may be between about 15 and 45 degrees, rearwardly to the vertical. The upper end or apex of the cross slot 34*a* is in the form of a round 36*a* that extends substantially to the upper perimeter of the chamber 30*a* such that the discharge orifice 31*a* has a cross sectional area greater than the cross sectional area of the chamber 30*a* for minimizing clogging and wear about the discharge orifice 31*a* and deflector surface 32*a*, while generating a discharging spray with a spray angle of between about 120 and 130 degrees. For enhancing liquid breakdown and generation of a shallow bellcrank shaped liquid distribution curve, as indicated in the previous embodiment, the cross slot 34*a* is located upstream of the end of the chamber 30*a* so as to define a distinct pocket or recess 38*a* extending downstream of the deflector surface 32*a*.

Figure 6:
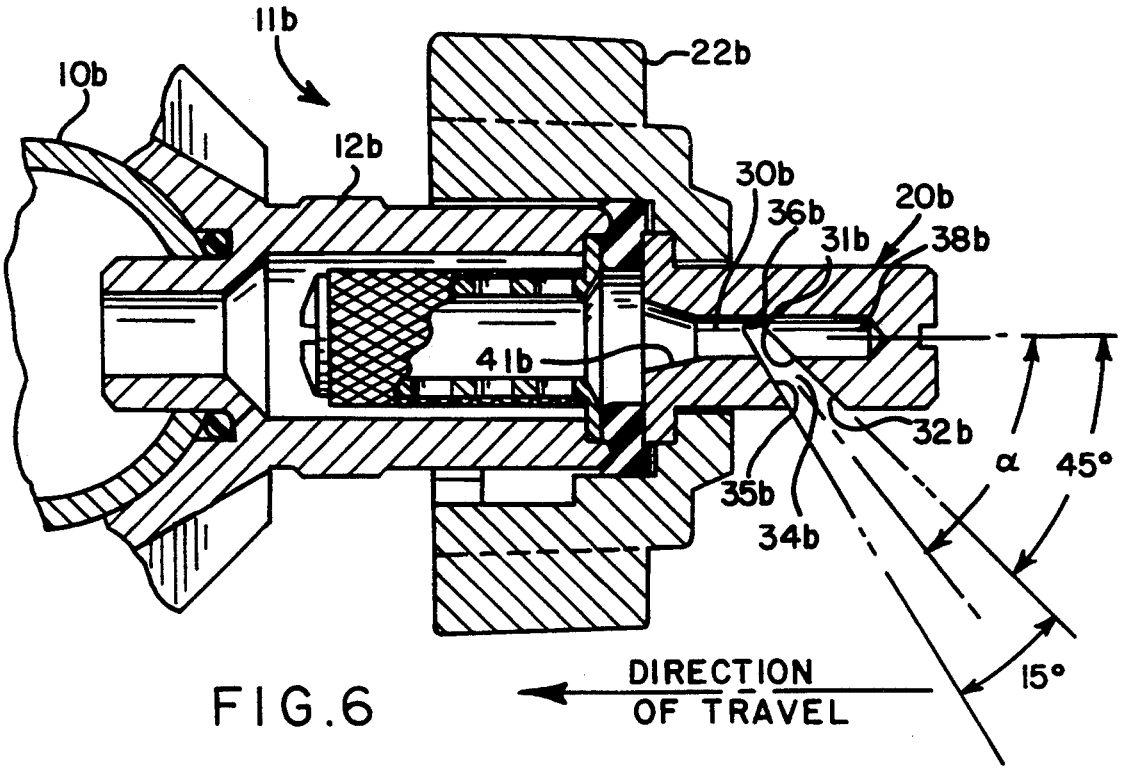
FIG. 6 is a vertical section of another embodiment of the spray nozzle assembly according to the present invention.

Referring now to FIG. 6, there is shown another alternative embodiment of spray nozzle assembly 11*b* wherein items similar to those described above have been given similar reference numerals with the distinguishing suffix "b" added. The nozzle assembly 11*b* in this case includes a spray tip 20*b* mounted on a stem 12*b* extending horizontally from the liquid supply boom 10*b*. The spray tip 20*b* is formed with tapered entry throat 41*b* which communicates with an axial chamber 30*b*. The discharge orifice 31*b* is defined by a cross slot 34*b* formed in the underside of the spray tip 20 at acute angle α to the axis of the spray tip 20*b* and the horizontal, which in the illustrated embodiment is about 52 ½ degrees. The cross slot 34*b* defines a downstream deflection surface 32*b* and an upstream surface 35*b* disposed at an angle Θ to each other which preferably may be about 15 to 45 degrees, resulting in the deflection surface being oriented at an angle to the axis of the spray tip. The apex of the cross slot is formed with a round 36*b* in this instance extending above the axis of the spray tip chamber to about the upper perimeter thereof for causing the discharge orifice 31*b* to have an area greater than the area defined by the diameter of the chamber 30 for preventing clogging and wear in the vicinity of the cross slot 34*b* and the deflector surface 32*b*. The cross slot 34*b* again intersects the chamber 30*b* at a location intermediate its ends for defining a distinct recess or pocket 38*b* on the downstream side of the deflector surface 32*b*. With the spray tip 30*b* horizontally mounted, as illustrated in FIG. 6, the discharging spray pattern is directed in a downward and forward direction, again with a shallow bell-shaped liquid distribution curve similar to that previously described.

Figure 7:
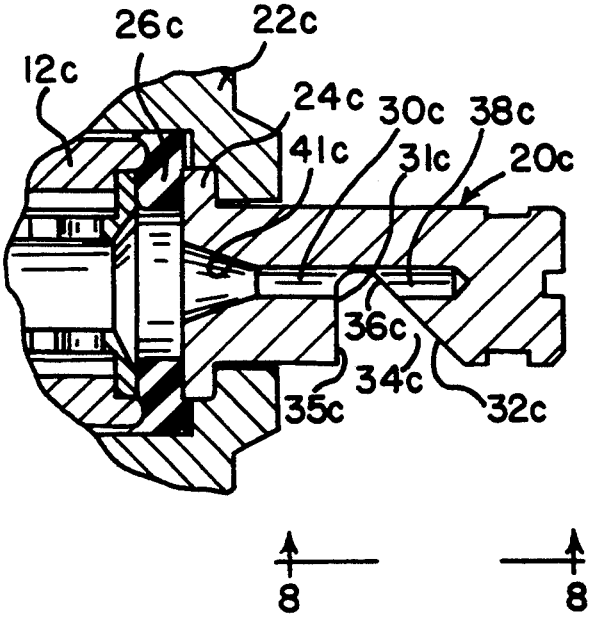
FIG. 7 is a vertical section of still another alternative embodiment of the nozzle assembly according to the present invention.
Figure 8:
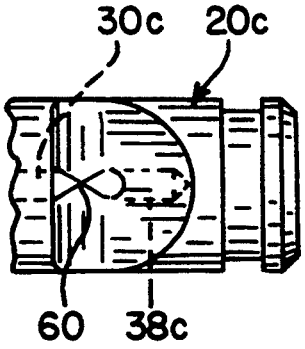
FIG. 8 is a bottom view of the spray tip included in the nozzle assembly shown in FIG. 7.

Referring now to FIGS. 7 and 8, there is shown still another alternative embodiment of spray nozzle assembly according to the present invention wherein items similar to those described above have been given similar reference numerals with the distinguishing suffix "c" added. The spray tip 20*c* again has a mounting flange 24*c* for securement to a horizontal stem of a spray boom. The spray tip 20*c* is formed with an inwardly tapered entry throat 41*c* communicating with an axial chamber 30*c*. A cross slot 34*c* in the underside of the spray tip defines a discharge orifice 31*c*, a downstream deflection surface 32*c*, preferably at an angle of between about 15 and 45 degrees to the horizontal, and a vertical upstream face 35*c*. The upstream and downstream faces 35*c*, 32*c* defined by the cross slot 34*c* have an apex in the form of a round 36*c* that extends about to the upper perimeter of the chamber 30*c* intermediate the ends thereof for defining a recess or pocket 38*c* downstream of the deflection surface 32*c*. In the event that the spray tip 20*c* is machined from metal stock, the depth of the cross slot 34 can be easily determined by the machine operator by viewing the point of tangency 60 of the cross slot 34 with the upper perimeter of the chamber 30, as shown in FIG. 8. The round 36*c* in this instance has a radius which is about twice the diameter of the chamber 30*c* for defining a discharge orifice 31*c* with significantly greater area than the diameter of the chamber for permitting free passage of solids containing liquids and for minimizing wear in the area of the discharge orifice and deflection surface, while at the same time generating a relatively wide angle spray pattern with a shallow bell-shaped liquid distribution curve substantially similar to that previously described.

Figure 9:
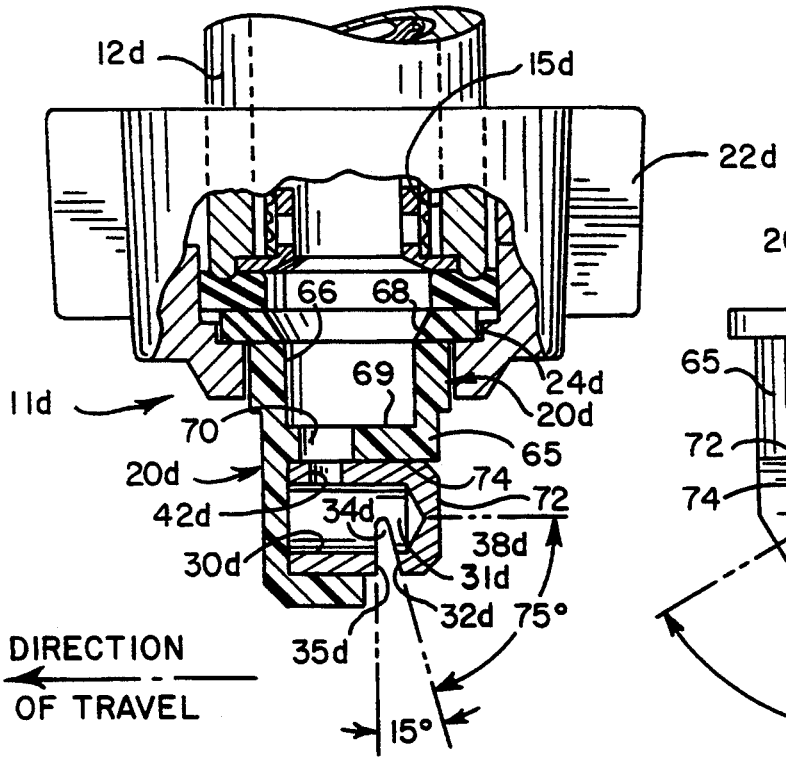
FIG. 9 is a side elevational view, in partial section, of still a further alternative embodiment of the spray nozzle assembly according to the present invention.
Figure 10:
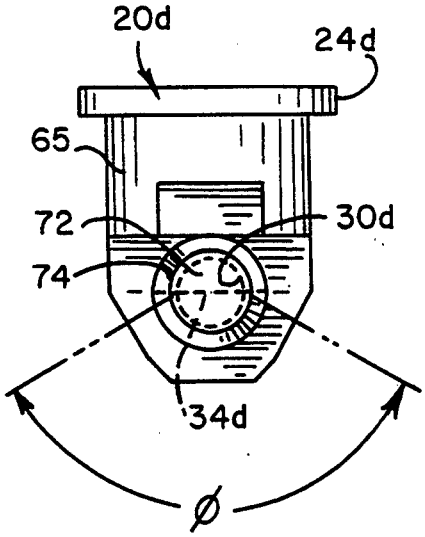
FIG. 10 is a right-side elevational view of the spray tip of the nozzle assembly shown in FIG. 9.

Referring now to FIGS. 9–10, there is shown a further alternative spray nozzle assembly wherein items similar to those described above have been given similar reference numerals with the distinguishing suffix "d" added. The spray nozzle assembly 11*d* in this case includes a spray tip 20*d* having a body 65, preferably molded of plastic, formed with an outwardly extending mounting flange 24*d* at its upstream end for releasable securement to a stem 12*d* by a retention cap 22*d*. The spray tip body 65 has an upper end formed with a first cylindrical chamber 66 communicating at an upstream end with a stem passageway 15*d* through a tapered throat 68. The first cylindrical chamber 66 has a vertical axis coincident with the axis of the stem passageway 15*d* and a bottom or end wall 69 formed with an eccentrically located outlet passage 70 substantially smaller than the diameter of the chamber 66.

In accordance with a further feature of the invention, the spray tip 20*d* has a metallic tip insert 72 which is horizontally supported in the lower end of the body 65 and formed with an elongated cylindrical expansion chamber 30*d* having a small diameter pre-orifice 42*d* in a side wall thereof adjacent an upstream end communicating with the first chamber outlet passage 70. The pre-orifice 42*d* in this case is smaller than the first chamber outlet passage 70 such that the discharge passage 70 defines an entry passage to the pre-orifice 42*d*. The expansion chamber 30*d* has a cylindrical configuration with an axis at an angle, in this case perpendicular, to the axis of the first chamber 66 and the pre-orifice 42*d* is formed in a top side of the insert 72 adjacent the upstream end.

For supporting the tip insert 72, the spray tip body 65 is formed with a cylindrical cavity 74 opening to one side thereof and the spray tip insert 72 is mounted within the cavity 74 with a downstream end extending out of the open side. The insert 72 preferably is press fit within the cavity 74.

For defining a discharge orifice 31*d* for the nozzle assembly and a deflection surface 32*d* for directing a discharging liquid spray in a substantially downward direction, the spray tip insert 72 is formed with a substantially vertically oriented cross-slot 34*d* which extends through an exposed underside of the insert 72 adjacent an end of the chamber 30*d* opposite the pre-orifice 42*d*. The cross slot 34*d* has a "V" configuration with an upstream face 35*d* thereof vertically oriented and a downstream face 32*d* disposed at an angle Θ, preferably between about 15 degrees, to the vertical. The upper end or apex of the cross slot 34*d* is in the form of a round that extends about to the horizontal axis of the spray tip insert expansion chamber 30*d*. For enhancing liquid breakdown and generation of a shallow liquid distribution curve, the cross slot 34*d* is located upstream of the end of the chamber 30*d* so as to define a distinct pocket or recess 38*d* extending downstream of the deflector surface 32*d*. The discharge orifice 31*d* preferably has an area equal to or greater than the area of the pre-orifice 42*d* for insuring the free passage of the liquid entering the chamber 30*d*.

It will be appreciated by one skilled in the art that while the spray tip 20*d* may be mounted on a vertically oriented stem 12*d* for downwardly directed spraying, the tip 20*d* nevertheless has a relatively simple and compact design. Moreover, while the plastic spray tip body 65 lends itself to economical manufacture, the metallic spray tip insert 72 permits long term wear resistance usage of the nozzle assembly 11*d*.

Figure 11:
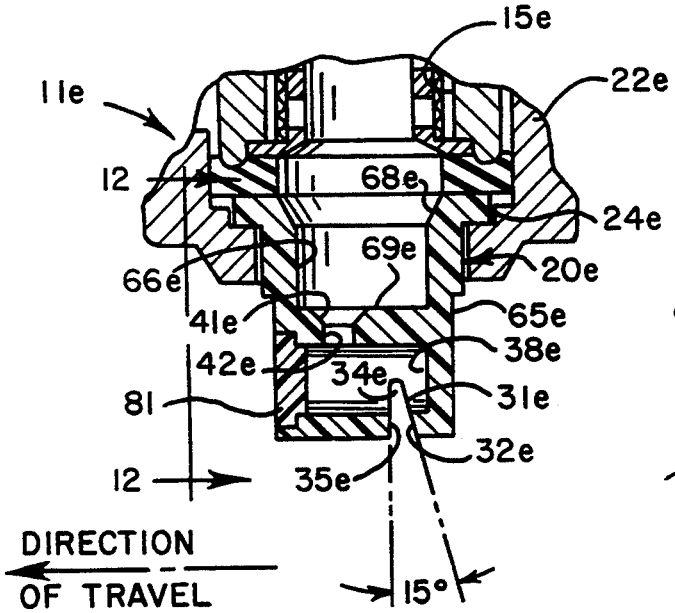
FIG. 11 is a fragmentary vertical section of another alternative embodiment of the spray nozzle assembly.
Figure 12:
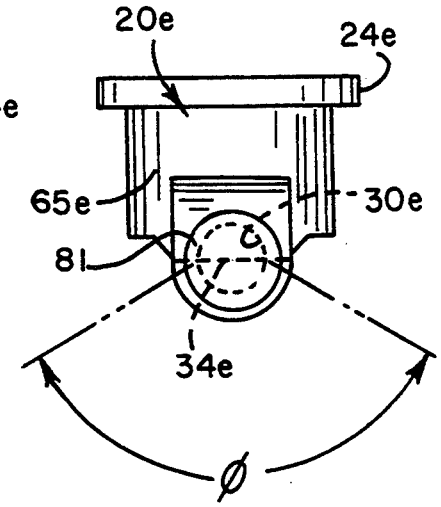
FIG. 12 is a right-side elevational view of the spray tip of the nozzle assembly shown in FIG. 11.

Referring now to FIGS. 11–12, there is shown a spray nozzle assembly 11*e*, substantially similar to that shown in FIGS. 9–10, but formed entirely of plastic. The spray nozzle assembly 11*e* includes a spray tip 20*e* having a body 65*e* formed with a first vertically oriented, cylindrical chamber 66*e* having a tapered entry throat 68*e* at an upstream end. The chamber 66*e* has a bottom or end wall 69*d* in this case directly formed with a pre-orifice 42*e* disposed in off-centered relation to the axis of the chamber 66*e*. The pre-orifice 42*e* has a tapered upstream entry throat 41*e*.

In accordance with a feature of this embodiment of the invention, the nozzle body 65*e* defines a second cylindrical expansion chamber 30*e* disposed below the first chamber 66*e* with the pre-orifice 42*e* communicating with a top side of the expansion chamber 30*e* adjacent an upstream end thereof. The nozzle body 65*e* further is formed with a discharge orifice 31*e* defined by a cross slot 34*e* extending upwardly from an underside of the nozzle body 65*a* adjacent an end of the horizontal chamber 30*e* opposite that of the pre-orifice 42*e*. The discharge orifice 31*e* again has an upstream face 35*e* that is vertically oriented and a downstream face 32*e* disposed at a small angle Θ to the vertical, preferably between about 15 and 45 degrees. The cross slot 34*e* is disposed upstream of the end of the expansion chamber 30*e* so as to define a distinct pocket or recess 38*e* downstream of the deflector surface 32*e*. To facilitate plastic injection molding of the nozzle body 65, it will be appreciated by one skilled in the art that the plastic body 65 may be formed with the second chamber 30*e* open at one end, such as at the upstream end, which can thereafter be closed by a plastic plug 81, which may be secured by ultrasonic welding.

Still another embodiment of a spray nozzle assembly 11*f* is shown in FIGS. 13–19 and is generally similar to the nozzle assembly 11*e* of FIGS. 11 and 12. The nozzle assembly 11*f* is particularly characterized in that its spray tip 20*f* is capable of discharging spray at relatively high flow rates and may be easily assembled to and interlocked with a standard mounting or retention cap 22*f*.

Specifically, the nozzle assembly lie includes a vertically extending stem 12*f* with a central passageway 15*f* having a strainer 28*f* therein. The strainer is formed with a lower flange 29*f* which, together with the lower end of the stem, serves to back and support the upper end of a sealing gasket 26*f*.

The retention cap 22*f* is of standard plastic construction and comprises a tubular body 85 which receives the lower end of the stem 12*f* as well as the strainer 28*f* and the gasket 26*f*. The lower end of the body is closed by a horizontal bottom wall 86 having a double D-shaped opening 87 extending vertically therethrough. As shown most clearly in FIG. 14, the opening is defined by two generally straight and generally parallel side walls 88 and by two concavely curved and generally arcuate end walls 89. The opening is elongated in a direction extending perpendicular to the direction of travel of the spray boom and thus the dimension A between the curved end walls 89 of the opening is significantly greater (e.g., approximately 25% greater) than the dimension B between the straight side walls 88. For a purpose to be described subsequently, one of the side walls 88 of the opening is defined by two resiliently cantilevered fingers 90.

In carrying out the invention, the nozzle tip 20*f* is formed with an elongated downstream or lower body section 25*f* defining an elongated and high capacity cylindrical expansion chamber 30*f* whose length in the direction of travel is significantly longer than the minor dimension B of the opening 87 so that the tip can discharge spray at a high flow rate. Moreover, the nozzle tip 20*f* is adapted to be assembled with the conventional cap 22*f* by slipping the lower body section 25*f* downwardly through the opening 87, by then turning the tip relative to the cap in order to orient the lower body section in the same direction as the direction of travel, and thereafter by lowering the tip still further in order to lock the tip against rotation relative to the cap.

More particularly, the lower body section 25*f* of the nozzle tip 20*f* is generally similar to but is significantly longer than the lower body section of the nozzle tip 20*e* of the embodiment of FIGS. 11 and 12. The lower body section 25*f* is molded of plastic and its leading end is capped by an ultrasonically welded plastic plug 81*f* which closes off the leading or upstream end of the expansion chamber 30*f*. As before, the body section 25*f* is formed with a discharge orifice 31*f* defined by a cross-slot 34*f* extending upwardly from the underside of the body section adjacent the end thereof remote from the plug 81*f*. And, as before, the discharge orifice 31*f* has a leading face 35*f* that is vertically oriented and a trailing deflector face 32*f* disposed at a small angle (e.g., about 15 degrees) relative to vertical. A distinct pocket or recess 38*f* is formed at the trailing end of the chamber 30*f* by virtue of the cross-slot 34*f* being formed between the ends of the chamber. In the embodiment of FIGS. 13–19, the cross-slot terminates short of the axis of the chamber.

The nozzle tip 20*f* includes an upper or upstream body section 91 molded integrally with and located above the lower body section 30*f*. The upper body section includes integral lower, intermediate and upper portions 92, 93 and 94, respectively, together with an integral top flange 24*f*. When the nozzle tip 20*f* is fully assembled with the cap 22*f*, the flange 24*f* is sandwiched between the gasket 26*f* and an internal shoulder 95 in the cap 22*f*.

Figure 15:
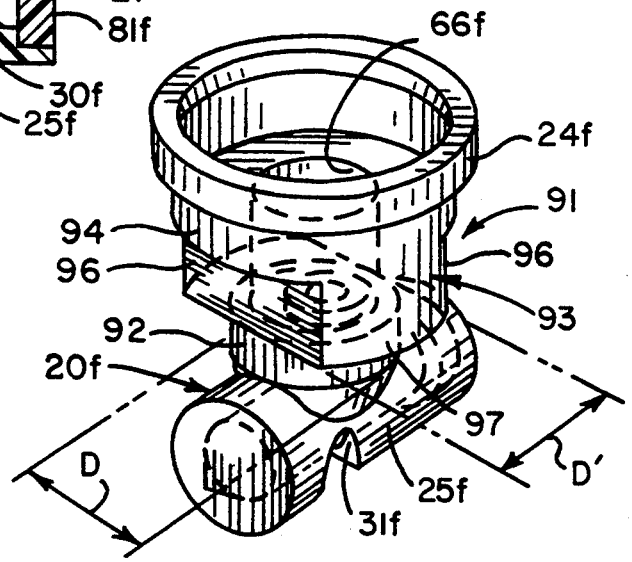
FIG. 15 is a perspective view of the spray tip of the nozzle assembly shown in FIG. 13.
Figure 14:
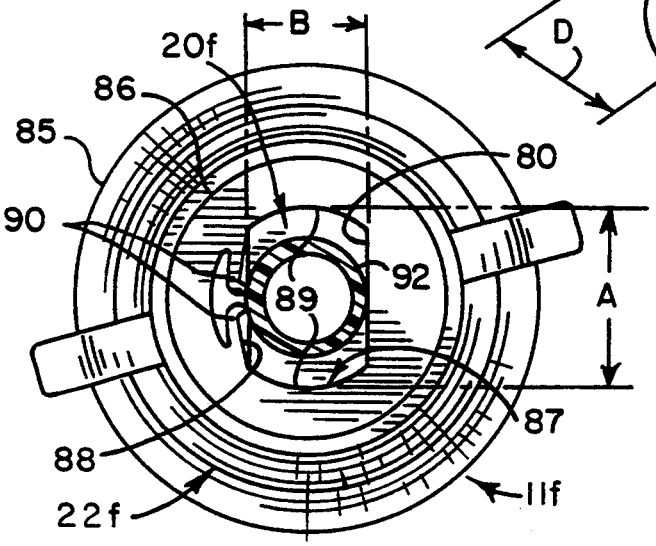
FIG. 14 is a reduced cross-sectional view taken substantially along the line 14—14 of FIG. 13.

As shown most clearly in FIG. 15, the lower portion 92 of the upper body section 91 is located directly above the lower body section 25*f*. The lower portion 92 is cylindrical in shape and its diameter D (FIGS. 15–17) is approximately equal to or is just slightly greater than the dimension D between the side walls 88 of the opening 87.

The intermediate portion 93 of the upper body section 91 is formed integrally with and is located immediately above the lower cylindrical portion 92 and is complementary in size and shape to the double D-shaped opening 87 in the cap 22*f*. Thus, the intermediate portion 93 includes two straight and parallel sides or flats 96 (FIG. 15) and two convexly and arcuately curved ends 97. The distance D′ (FIGS. 15 and 18) between the two flats 96 is equal to the diameter D of the lower cylindrical portion 92 and is equal to or just slightly greater than the dimension B between the straight sides 88 of the opening 87 when the fingers 90 are in a relaxed condition. The dimension between the curved ends 97 of the intermediate portion 93 is equal to or just slightly smaller than the distance A between the curved ends 89 of the opening 87.

The upper portion 94 of the upper body section 91 is cylindrical and has the same diameter as the curved ends 97 of the intermediate portion 93. The flange 24*f* is formed integrally with the upper cylindrical portion 94 and is sufficiently large in diameter to engage and stop against the shoulder 95 of the cap 22*f*.

Figure 13:
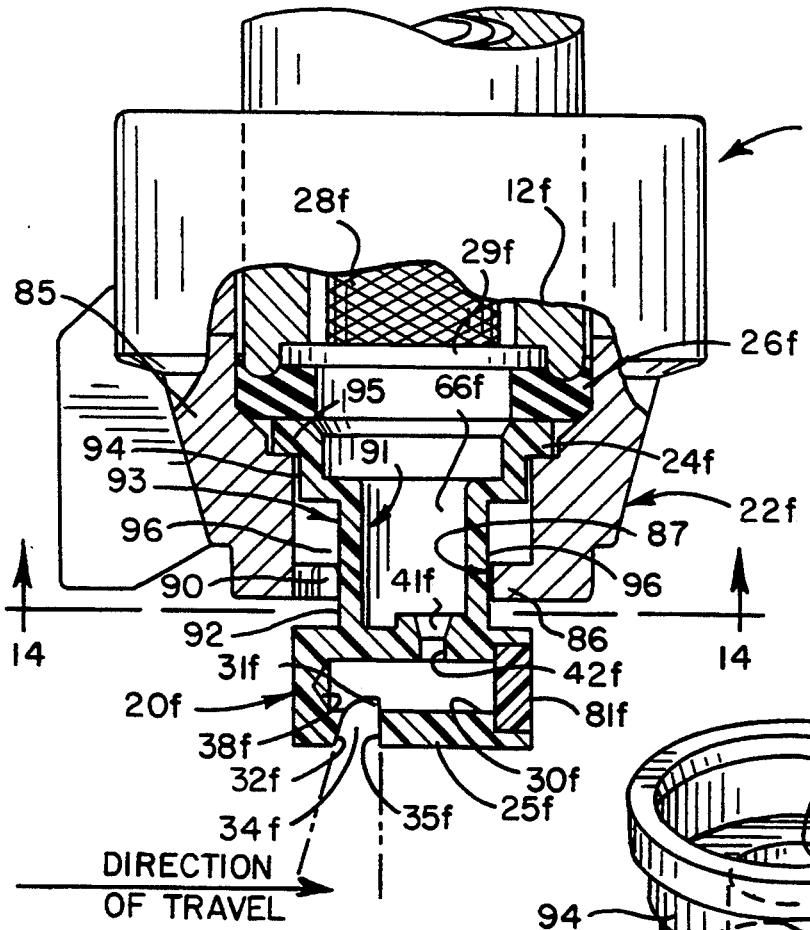
FIG. 13 is a view similar to FIG. 9 but shows still another alternative embodiment of the spray nozzle assembly.

As shown most clearly in FIG. 13, the lower and intermediate portions 92 and 93 of the upper body section 91 define an upstream chamber 66*f* which is cylindrical and vertically oriented. A pre-orifice 42*f* establishes communication between the chamber 66*f* and the expansion chamber 30*f*. As before, the pre-orifice is offset from the axis of the chamber 66*f* and is formed with a tapered upstream entry throat 41*f*.

Figure 16:
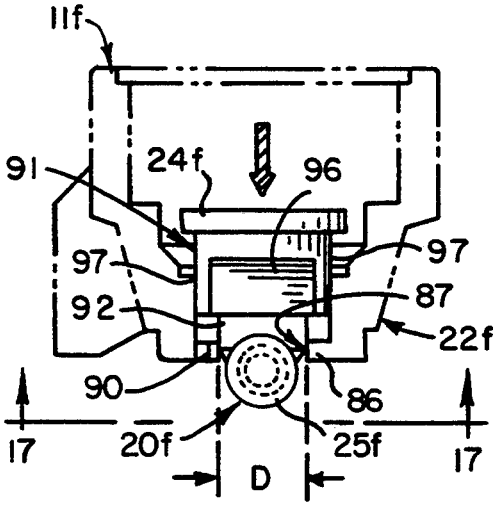
FIG. 16 is a view schematically showing the first step of assembling the nozzle tip of FIG. 15 with the retention cap of the nozzle assembly.
Figure 18:
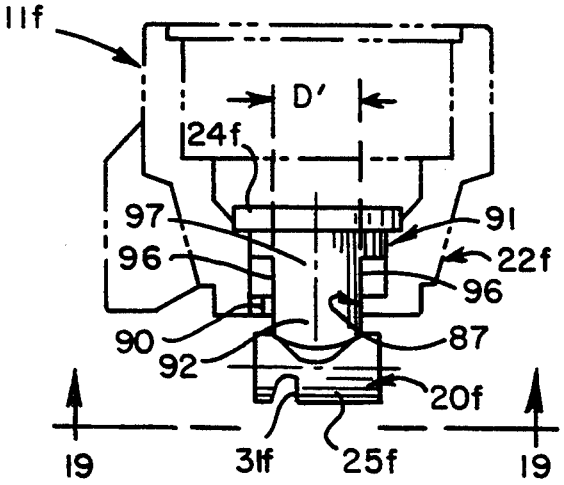
FIG. 18 is a view similar to FIG. 16 but shows a subsequent step of assembling the nozzle tip and the retention cap.
Figure 17:
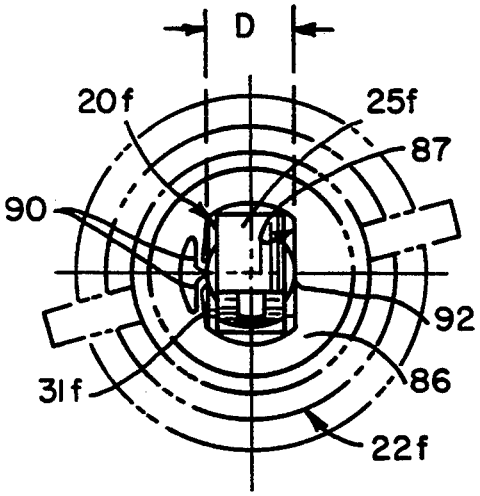
FIG. 17 is a bottom view as seen in the direction of the arrows of line 17—17 of FIG. 16.
Figure 19:
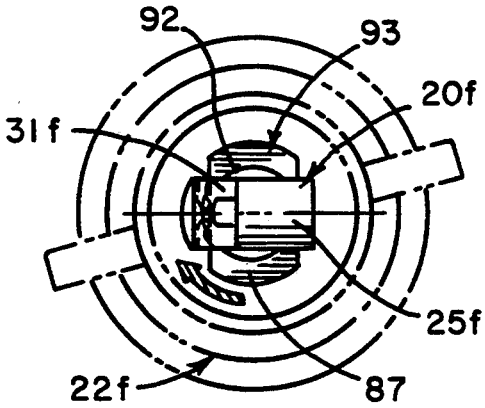
FIG. 19 is a bottom view as seen in the direction of the arrows of line 19—19 of FIG. 18.

With the foregoing arrangement, the nozzle tip 20*f* may be assembled with the cap 22*f* by slipping the tip downwardly into the upper end of the cap while the tip is oriented angularly as shown in FIGS. 16 and 17, that is, with the elongated lower body section 25*f* oriented so as to extend transversely of the direction of travel and extending parallel to the long dimension A of the opening 87. When the tip 20*f* is so oriented, the lower body section 25*f* may be inserted downwardly through the opening 87 and beyond the end wall 90. Downward movement of the nozzle tip is momentarily stopped after the cylindrical lower portion 92 of the upper body section 91 enters the opening 87, such entry being permitted by virtue of the diameter D of the cylindrical portion 92. Thereafter, the tip is turned clockwise from the position shown in FIGS. 16 and 17 to the position shown in FIGS. 18 and 19. In the latter position, the elongated lower body section 25*f* with the elongated expansion chamber 30*f* extends in the direction of travel of the spray boom. Moreover, the flat sides 96 and curved ends 97 of the intermediate portion 93 of the upper body section 91 are aligned with the straight sides 88 and curved ends 89, respectively, of the opening 87. Accordingly, assembly of the nozzle tip may be completed by pushing the tip downwardly to cause the intermediate portion 93 to enter the opening 87, the complementary double D shapes of the intermediate portion and the opening preventing further turning of the nozzle tip. In addition, the fingers 90 resiliently engage the flat surfaces 96 to hold the tip snugly in the opening.

From the foregoing it can be seen that the spray nozzle assembly of the present invention is particularly adaptable for spraying agricultural chemicals with a substantially uniform liquid distribution over the area being sprayed. The nozzle assembly may be used in both purely hydraulic and air-assisted spray applications, and in the latter case, is easily adaptable for directing discharging sprays in a substantially straight downward direction. The nozzle is less susceptible to undesirable wear and clogging. In the case of the nozzle assembly 11*f* of FIGS. 13–19, the long dimension of the lower body section 25*f* of the nozzle tip 20*f* is significantly greater than the short dimension B of the standard retention cap 22*f*. The construction of the nozzle tip 20*f*, however, enables the elongated lower body section to be inserted through the opening 87 and turned into alignment with the direction of travel prior to the tip being locked against rotation relative to the cap. With this arrangement, the long dimension of the expansion chamber 30*f* may be significantly greater than the dimension B of the opening 87 and thus the chamber is of high capacity and capable of discharging spray at high flow rates.

I claim:

1. A spray nozzle assembly comprising a stem defining a passage through which a supply of liquid is directed, a spray tip, and a tubular cap for mounting said spray tip on said stem, said cap having a lower end with a vertically extending opening therethrough, said opening having a long dimension along one horizontal coordinate and a significantly shorter dimension along a perpendicular horizontal coordinate, said spray tip having upper and lower plastic body sections molded integrally with one another, said upper body section being at least partially disposed within said cap in communication with said passage and having integral means for preventing said tip from falling downwardly out of said cap through said opening, said lower body section being located below said lower end of said cap and having a long horizontal dimension substantially longer than the shorter dimension of said opening, said tip being oriented angularly in said cap such that the long dimension of said lower body section extends along the same horizontal coordinate as the shorter dimension of said opening, said lower body section having an elongated expansion chamber communicating with said upper body section and extending along the same horizontal coordinate as the long dimension of said lower body section, and a downwardly directed discharge orifice formed in said lower body section for spraying liquid from said expansion chamber.

2. A spray nozzle assembly as defined in claim 1 in which said opening is generally double D-shaped, said upper body section having a portion disposed in said opening and formed with substantially the same shape as said opening so as to prevent said nozzle tip from turning relative to said cap.

3. A spray nozzle assembly as defined in claim 1 further including a pre-orifice formed in said nozzle tip between said upper and lower body sections and located upstream of said discharge orifice.

4. A spray nozzle assembly comprising a stem defining a passage through which a supply of liquid is directed, a spray tip, and a cap for mounting said spray tip on said stem, said cap having a lower end with a vertically extending opening therethrough, said spray tip having an upper body section at least partially disposed within said cap and formed with an upstream chamber adapted to communicate with said passage, said tip having a lower body section located below the lower end of said cap and defining an elongated expansion chamber, said lower body section including a cross-slot intersecting said elongated expansion chamber at a location intermediate opposite ends thereof and defining a discharge orifice below said cap, said tip having a pre-orifice located upstream of said discharge orifice and establishing communication between said chambers, said opening through said cap having a long dimension along one horizontal coordinate and having a substantially shorter dimension along a perpendicular horizontal coordinate, said lower body section having an elongated horizontal dimension substantially equal to the long dimension of said opening and substantially longer than the shorter dimension of said opening whereby said lower body section may be inserted into said cap and moved downwardly through said opening, said upper body section having first surface means sized and shaped to permit said tip to be turned within said opening after said lower body section has moved downwardly through said opening whereby said tip may be oriented in an active position with the elongated dimension of said lower body section extending transversely of the long dimension of said opening, and said upper section of said tip having second surface means sized and shaped to coact with said opening and prevent turning of said tip after said tip has been oriented in said active position and following further downward movement of said tip relative to said cap.

5. A spray nozzle assembly as defined in claim 4 in which said opening and said second surface means are generally double D-shaped, said first surface means being generally cylindrical and having a diameter approximately equal to the shorter dimension of said opening.

6. A spray nozzle assembly comprising a stem defining a passage through which a stream of liquid is directed, a spray tip, and a cap for mounting said tip on said stem, said tip having an upstream body section defining an upstream chamber and having an elongated downstream body section integral with said upstream section and defining an elongated expansion chamber, said upstream chamber communicating with said passage, a pre-orifice establishing communication between said chambers, said downstream body section including a cross-slot intersecting said elongated expansion chamber intermediate the ends thereof and defining a discharge orifice downstream of said pre-orifice, said cap being generally tubular and having an end wall with an opening formed therethrough, said opening being generally double D-shaped and being defined by two substantially parallel straight sides and by two concavely curved and generally arcuate ends, the dimension between the curved ends of said opening being substantially greater than the dimension between the straight sides of said opening, said upstream body section being at least partially located within said cap and having a first portion positioned within said opening and shaped so as to coact with the sides of said opening to prevent turning of said tip relative to said cap, said upstream body section having a second portion located outside of said cap beyond said opening and shaped, when located in said opening, to permit turning of said tip relative to said cap, said elongated downstream body section being integral with the second portion of said upstream section and being located outside of said cap with said elongated expansion chamber extending generally perpendicular to the straight sides of said opening and through a distance significantly greater than the dimension between said straight sides.

* * * * *